United States Patent [19]

Balme et al.

[11] 4,068,983

[45] Jan. 17, 1978

[54] PISTON PUMPS DRIVEN BY FLUID-ACTUATED PISTON HAVING A CONSTANT FLUID FORCE AGAINST THE SMALL AREA SURFACE

[75] Inventors: Roy Balme, Altrincham; John Francis Perkins, Newton, near Walsall, both of England

[73] Assignee: Charles S. Madan & Company Limited, Altrincham, England

[21] Appl. No.: 599,405

[22] Filed: July 28, 1975

[51] Int. Cl.[2] ..... F04B 17/00; F04B 35/00 F01B/7/18

[52] U.S. Cl. ..... 417/401; 91/298; 91/321

[58] Field of Search .....417/392, 417/398, 401; 91/298, 320, 321

[56] References Cited

U.S. PATENT DOCUMENTS

| | | | |
|---|---|---|---|
| 245,777 | 8/1881 | Brazelle | 91/321 |
| 574,003 | 12/1896 | Rinsche | 91/298 |
| 973,378 | 10/1910 | Otto | 91/298 |
| 1,306,301 | 6/1919 | Chadwick | 91/321 |
| 2,348,243 | 5/1944 | Cole | 91/298 |
| 2,406,747 | 9/1946 | Davis | 91/321 |
| 3,440,967 | 4/1969 | Pennther | 417/397 |
| 3,839,863 | 10/1974 | Frazier | 417/401 |

*Primary Examiner*—Carlton R. Croyle
*Assistant Examiner*—Thomas I. Ross
*Attorney, Agent, or Firm*—Ralph W. Kalish

[57] ABSTRACT

A reciprocating pump for liquids has a shuttle valve for directing motive fluid alternatively to small- and large-area faces of a piston. The motive fluid directed to the small-area face acts as a spring for causing reciprocation.

7 Claims, 6 Drawing Figures

PISTON PUMPS DRIVEN BY FLUID-ACTUATED PISTON HAVING A CONSTANT FLUID FORCE AGAINST THE SMALL AREA SURFACE

The invention relates to reciprocating pumps for liquids, and is particularly but not exclusively concerned with pumps for the generation of hydraulic pressure from pneumatic pressure. Suitable pneumatic pressure may for example be available from compressed air in a factory, or from natural or bottled gas under pressure. The hydraulic pressure generated by pumps according to the invention is useful for driving hydraulic mechanism.

The invention provides a reciprocating pump for liquids comprising a piston slidable in a body, a shuttle valve for directing motive fluid to the piston, and means for directing motive fluid to a small-area face of the piston and thence in a first position of the piston in the body to one face of the valve shuttle and in a second position of the piston in the body to another face of the valve shuttle so that the shuttle valve directs motive fluid to or from a large-area face of the piston.

The said piston may have integral therewith or connected thereto a ram slidable in a cylinder for the generation of hydraulic pressure. Alternatively, the piston may itself comprise a cylinder slidable with respect to a fixed ram for the generation of hydraulic pressure. Pumps according to the invention are adaptable for the generation of hydraulic pressure by means of other mechanism. For example, a double-acting pump may have hydraulic rams projecting in opposite directions from the said piston. The hydraulic rams each slide in a cylinder for the generation of hydraulic pressure; the shuttle valve may be remote from the pump body or secured to one side thereof. A similar arrangement may be made with movable cylinders in the piston and fixed rams slidable therein.

The directing of motive fluid to a small-area face of the piston, which in operation is generally effected continuously, provides a bias which is an important feature of the invention. The provision in the pump body of mutually alternative means for conveying motive fluid to either of the faces of the piston makes for a compact arrangement of the pump, a high power output for a given weight of pump, and a simple mechanism. No diaphragm is necessary.

A preferred pump according to the invention has a hydraulic fluid or oil inlet and outlet in the bottom of the pump body. This allows a bank of pumps to be mounted in a row on side-by-side oil inlet and outlet manifolds. Motive fluid such as air can conveniently be fed to the tops of the pumps, and a desired pumping power can be built up from a number of standard pumps.

In another arrangement, a shuttle valve may control a number of air pistons, which may be slidable in different parts of a single casing or in different casings. In this way, the capacity of the pump can be increased.

Figure 1:
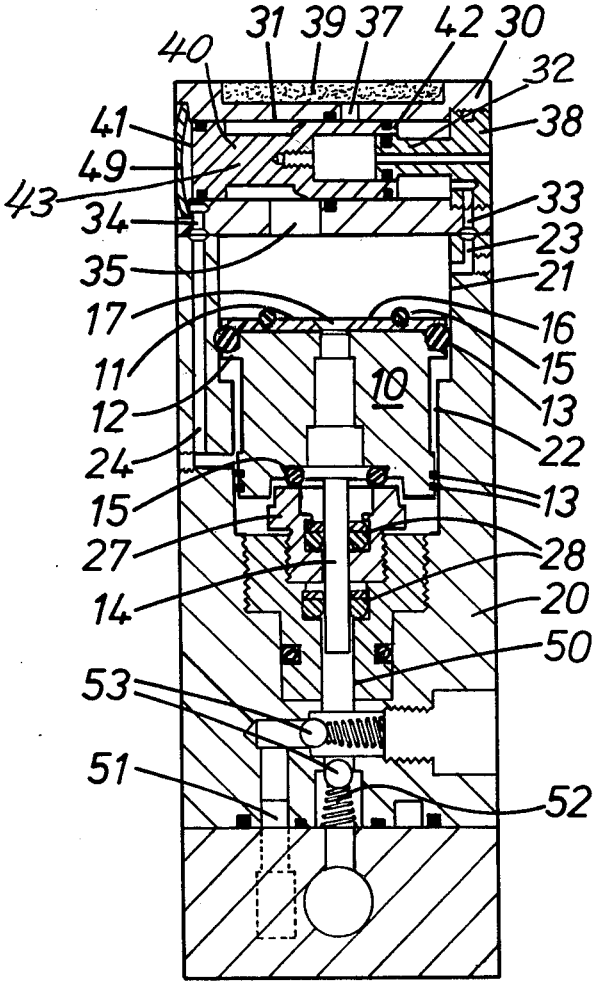
Figure 2A:
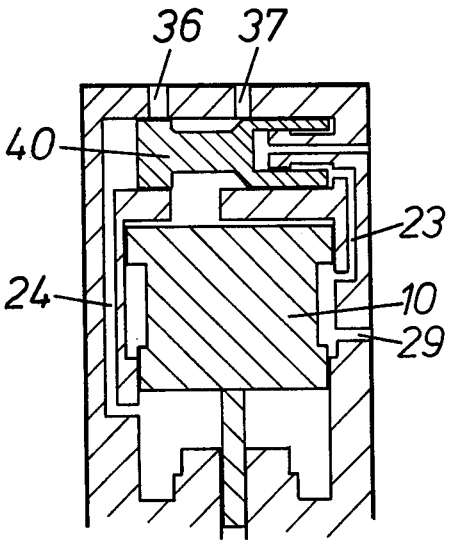
Figure 3:
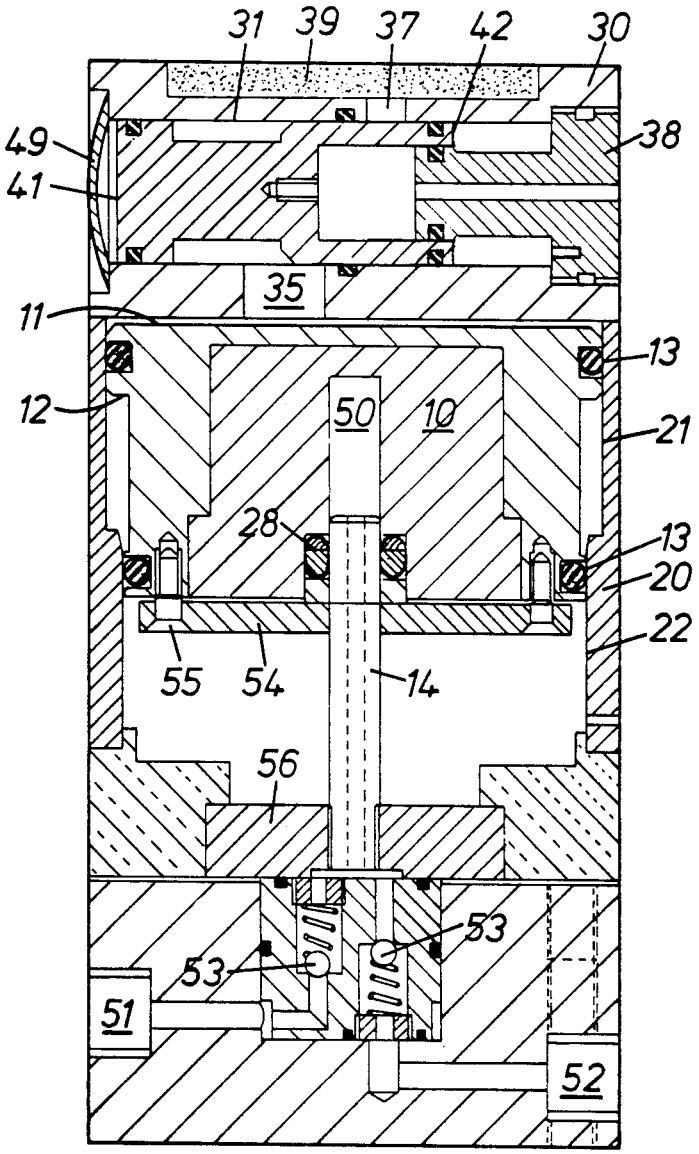

The drawings illustrate by way of example:

FIG. 1 a section through a pump according to the invention;

FIGS. 2A, B, C and D schematic sections through part of the pump of FIG. 1 in sequential operating positions; and FIG. 3 a modified pump similar to that of FIG. 1.

With particular reference to FIG. 1, the pump comprises an air piston 10 shown at the lower end of its strike within body 20. The air piston 10 has a large-area upper face 11, and an annular small-area lower face 12. O-rings 13 around each end of the piston 10 make seals with the inside of the body 20. O-rings 15 on the top and bottom of the air piston 10 ensure non-metallic contact between the air piston 10 and the inside of the body 20. The piston 10 is herein called the air piston because it is subject to direct motive fluid pressure, and to distinguish it from a hydraulic ram 14, integral therewith and projecting from its lower face. The ram 14 is held fast in the air piston 10 by means of a screw 17 (from the top of the piston) which is countersunk in a plate 16. The plate 16 helps secure the upper O-ring 15.

The body 20 comprises a large bore 21, and a small bore 22. Air passages 23, 24 respectively connect the large bore 21 and the small bore 22 permanently to a shuttle valve casing 30. In the machining of the air passages 23, 24, and of an oil passage described below, holes were drilled in the body 20 and blocked by grub screws. The body 20 has a signal air inlet 29 at the bottom of the large bore 21. The signal air inlet 29 does not appear in FIG. 1 because it is offset by 90° and so goes into the paper; it is however shown diagrammatically in FIG. 2. The body 20 also has a gland nut 27 screwed fast therein below the air piston 10, and seal rings 28 for the hydraulic ram 14 entering a hydraulic cylinder 50.

The shuttle valve casing 30 comprises a bore 31 and air passages 33, 34 as continuations respectively of the air passages 23, 24 in the pump body 20. A main air passage 35 leads from the center of the shuttle valve casing 30 to the large area face 11 of the air piston 10. The shuttle valve casing 30 is provided at the top with a main air inlet 36 and air exhaust outlet 37. The air inlet 36 does not appear in FIG. 1 because it is offset by 90° and so goes into the paper; it is however shown diagrammatically in FIG. 2. The exhaust outlet 37 is covered with a sintered disc silencer 39. A plug 38 fills the right hand end of the bore 31. The plug 38 has a radial groove and air passage which is a continuation of 33 and conveys air to a valve shuttle 40. The plug also comprises a fixed projection 32 extending into a recess in the valve shuttle 40. A disc 49 is jammed in the left hand end of the bore 31 to seal it.

The valve shuttle 40 has a large-area face 41, a small-area face 42, and a narrow central portion 43, and is slidable from left to right in the shuttle valve casing 30. The narrow portion 43 has a threaded recess in its right hand end purely for use in maintenance: a screw may be introduced and the valve shuttle 40 thereby withdrawn from the bore 31.

The hydraulic cylinder 50 is formed in the body 20 below the piston 10 and the gland nut 27. The gland nut 27 seals the hydraulic cylinder 50 from the air cylinder 21, 22. The hydraulic cylinder 50 is provided with an oil inlet 51, and an oil outlet 52. These are each controlled by a spring-loaded non-return ball valve 53.

Figure 2B:
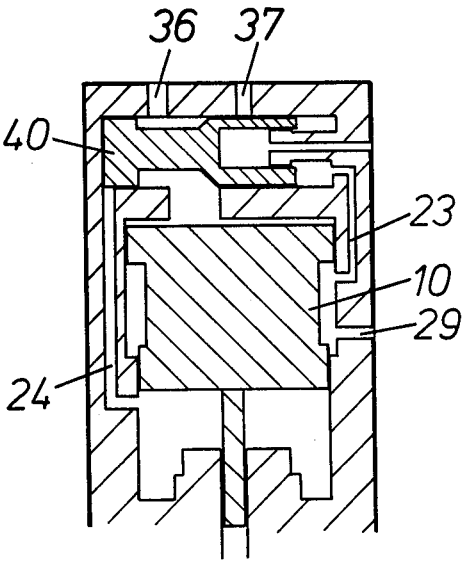
Figure 2C:
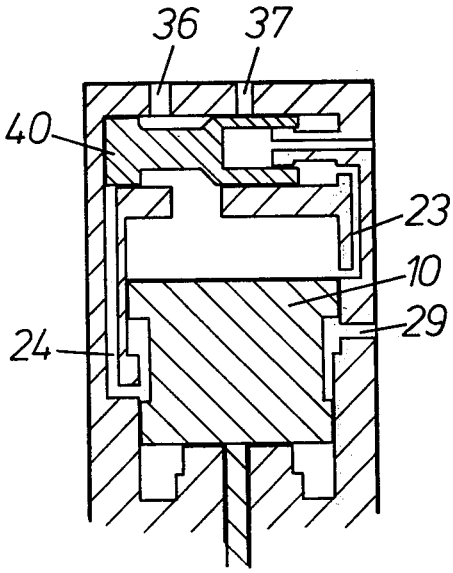
Figure 2D:
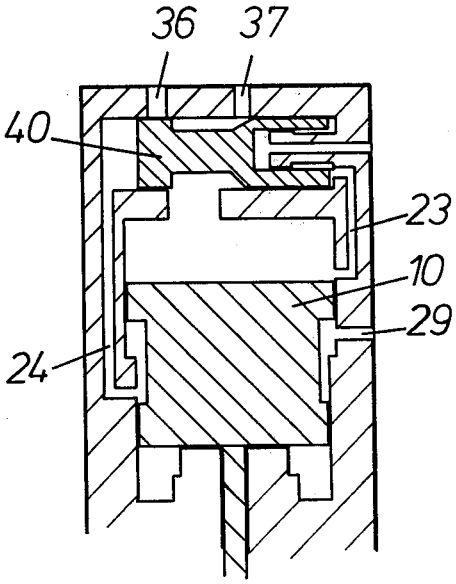

Signal air from the inlet 29 is directed to the small-area face 12 of the air piston 10. Thence, in a "first" position as shown in lines in FIG. 1, the signal air is directed through the passages 24, 34 to the large-area face 41 of the valve shuttle 40. In a "second" position, the signal air is directed through the passages 23, 33 to the small-area face 42 of the valve shuttle 40. In the "first" position, the signal air holds the valve shuttle 40 to the right as shown in FIG. 2D, and the main air passage 35 is connected to the exhaust outlet 37. In the "second" position the signal air holds the valve shuttle 40 to the left as shown in FIGS. 1 and 2B, and the main air passage 35 is connected to the main air inlet 36.

OPERATION

In FIG. 2A, the air pistion 10 has just reached the top of its stroke, and the air passage 23 leads signal air from the inlet 29 to the small-area face 42 of the valve shuttle 40. The passage 24 and large-area face 41 are cut off from signal air and so the valve shuttle 40 moves to the left, that is to the position shown in FIG. 2B. In this position, main air from the inlet 36 passes through the shuttle valve casing 30 to the large-area face 11 of the air piston 10. Signal air is still connected from the inlet 29 to the small-area face 12 of the air piston 10, but as the face 11 is larger, the air piston 10 moves down to the bottom of its stroke as shown in FIG. 2C. In this position, air pressure is still connected to the small-area face 42 of the valve shuttle 40 from the large-area face 11 of the air piston 10 through the passage 23, but signal air (at the same pressure) is connected from the inlet 29 through the passageway 24 to the large-area face 41. As the face 41 is of larger area than the face 42, the valve shuttle 40 moves to the right, to the position shown in FIG. 2D. At this point, the air piston 10 rises, exhausting air through the passages 35, 37 and the position shown in FIG. 2A is resumed.

The hydraulic piston 14 moves up and down with the air piston 10. On the up-stroke, the hydraulic piston 14 draws oil into the hydraulic cylinder 50 through the inlet 51. On the down-stroke, the hydraulic piston 14 expels oil through the outlet 52. The ball valves 53 open and close automatically under the oil pressure to ensure correct operation.

Turning now to FIG. 3, the pump shown is of larger capacity than that of FIG. 1, but otherwise very similar, so the same reference numerals have been used wherever possible to indicate corresponding parts and avoid repetition of description. The pump body 20 and air piston 10 is of square cross-section, and the air passages 23, 33 and 24, 34 are drilled along corners of the body 20 and so do not appear in FIG. 3. The air piston 10 has a flat top, and an insert (having a hydraulic cylinder 50 therein) secured to the air piston 10 by means of a plate 54 and screws 55. A hydraulic ram 14 is mounted fast on a base 56, and has a bore through which hydraulic fluid is pumped from an inlet 51 to an outlet 52. Operation is the same as the pump of FIG. 1.

We claim:

1. A reciprocating pump for liquids comprising a body, a piston slideably disposed within said body and having a large area face and a small area face, a shuttle valve casing associated with said pump body and having a motive air inlet and a motive air exhaust, a valve shuttle operable with respect to said motive air inlet and motive air exhaust having a large area face and a small area face disposed in said casing between said motive air inlet and motive air exhaust, and the large area face of said piston, said valve shuttle being slideable in said casing between a first position wherein it occludes said motive air inlet and a second position wherein said motive air inlet communicates with the large area face of said piston, signal air inlet means provided in said pump body and opening on the small area face of said piston, said signal air inlet means being positioned to continuously maintain signal air pressure on said small area face for all portions of said piston and at the same pressure as said motive air, first conduit means provided in said pump body and shuttle valve casing between said signal air inlet and the large area face of said shuttle valve for signal air flow to drive said valve shuttle into said first position, second conduit means provided in said pump body and shuttle valve casing between said signal air inlet and the small area face of said valve shuttle for signal air flow to drive said valve shuttle into said second position whereby said piston is driven in a pumping stroke by the pressure of said motive air against the large area face of said piston, hydraulic fluid receiving chamber means provided within said pump body and defining an inlet and outlet, and a pump ram for relative reciprocal movement within said chamber means responsive to movement of said piston, said pump ram expelling hydraulic fluid from said chamber means during a pumping stroke of said piston.

2. A reciprocating pump according to claim 1 in which the pump ram is integral with said piston.

3. A reciprocating pump according to claim 1 in which said hydraulic fluid receiving chamber means are provided within said piston, and said pump ram is fixed within said pump body whereby upon slideable movement of said piston said hydraulic fluid receiving chamber means moves relatively along said fixed ram.

4. A reciprocating pump as defined in claim 1 wherein said shuttle valve casing is integrally formed with said pump body.

5. A reciprocating pump as defined in claim 4 and further characterized by said piston being reciprocally slideable longitudinally of said pump body, said valve shuttle being slideable along an axis perpendicular to the axis of movement of said piston.

6. A reciprocating pump as defined in claim 4 and further characterized by said shuttle valve casing being integrally formed with said pump body and having its major axis normal to the major axis of said pump body.

7. A reciprocating pump as defined in claim 1 and further characterized by said pump ram and said piston being coaxial and means interengaging said pump ram and said piston.

* * * * *